US005601777A

United States Patent [19]

Fischer et al.

[11] Patent Number: 5,601,777

[45] **Date of Patent: *Feb. 11, 1997**

[54] PROCESS FOR COMPRESSING GRANULAR MATERIAL IN A MOLDING BOX

[75] Inventors: Kurt Fischer; Hans Leutwiler, both of Schaffhausen, Switzerland

[73] Assignee: Georg Fischer Giessereianlagen AG, Schaffhausen, Switzerland

[ * ] Notice: The term of this patent shall not extend beyond the expiration date of Pat. No. 5,348,070.

[21] Appl. No.: 327,321

[22] Filed: Oct. 21, 1994

[30] Foreign Application Priority Data

Oct. 27, 1993 [CH] Switzerland ..... 3236/93

[51] Int. Cl.[6] ..... B27N 3/02

[52] U.S. Cl. ..... 264/517; 264/547; 264/120; 164/38; 164/169

[58] Field of Search ..... 264/517, 544, 264/547, 120; 164/37, 38, 169

[56] References Cited

U.S. PATENT DOCUMENTS

| | | | |
|---|---|---|---|
| 4,828,007 | 5/1989 | Fischer et al. | 164/37 |
| 5,020,582 | 6/1991 | Damm et al. | 164/37 |
| 5,024,161 | 6/1991 | Fischer et al. | 164/169 |
| 5,161,596 | 11/1992 | Fischer et al. | 164/38 |
| 5,348,070 | 9/1994 | Fischer et al. | 164/38 |

*Primary Examiner*—Robert A. Dawson
*Assistant Examiner*—Kenneth M. Jones
*Attorney, Agent, or Firm*—Bachman & LaPointe, P.C.

[57] ABSTRACT

A process for compacting foundry molding material is proposed, the molding material being introduced into a molding device with a pattern plate with a pattern frame and a molding and filing frame mounted on it, by means of a compressed gas, the compressed gas being used at least for precompaction, the pressure surge used for the precompaction being released into the molding floor with a low, then a higher pressure gradient.

5 Claims, 1 Drawing Sheet

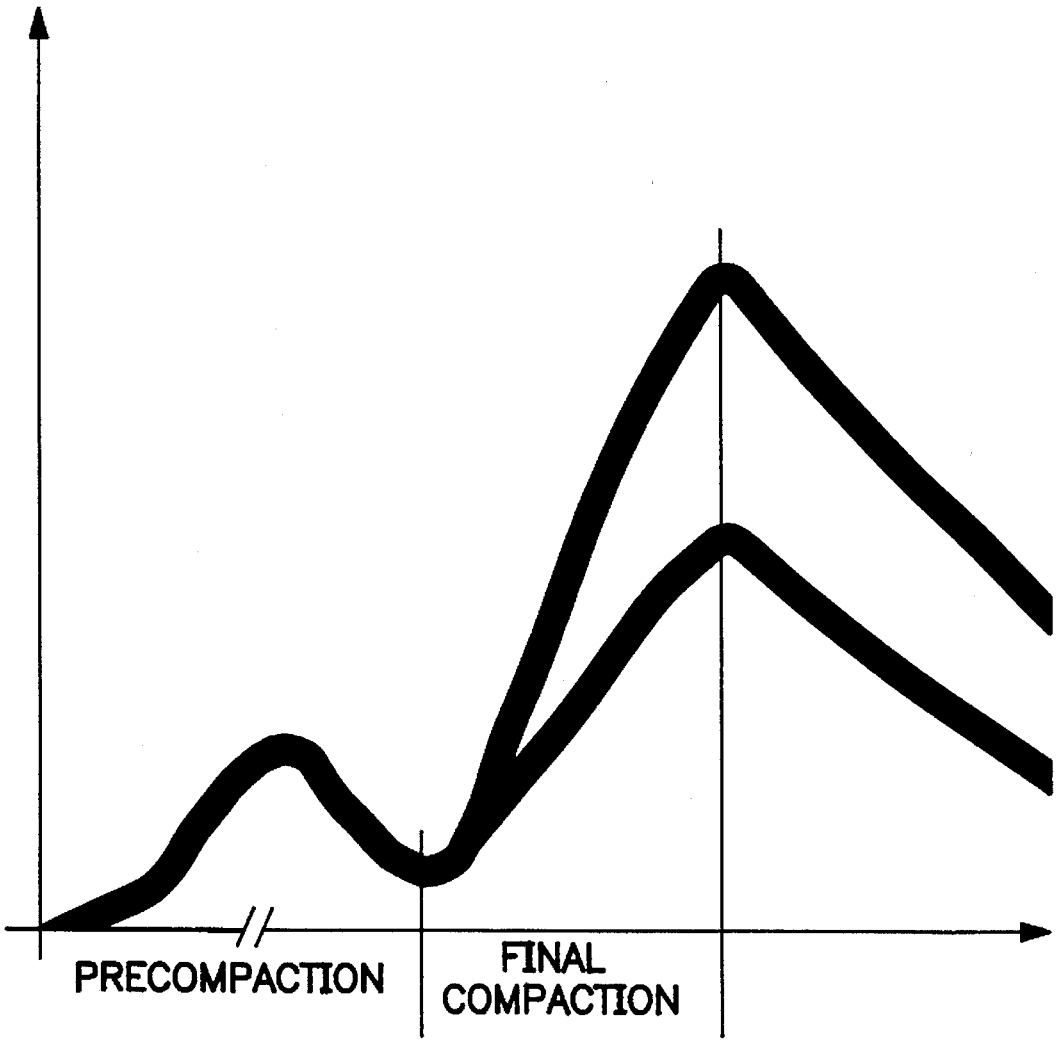
PRECOMPACTION
FINAL
COMPACTION

PROCESS FOR COMPRESSING GRANULAR MATERIAL IN A MOLDING BOX

BACKGROUND OF THE INVENTION

The present inventions relates to a process for selectively compressing granular material in a molding box and, more particularly, a process wherein the granular material is compressed by a precompression step followed by a final compression, the precompression step being carried in two stages.

The packing granular molding materials for the purposes of producing factory molds is old and well-known in the prior art. It is customary when packing the granular molding materials to provide a pre-determined amount of a compressed medium over the molding box which acts upon the granular material in the molding box to compress same. A typical process for packing granular molding material is to disclosed in German Patent No. 19 61 234 wherein the packing of the molding material is effected by the expansion of a high pressure gas within the molding apparatus. During the packing process, the gas, which is stored under pressure in a reservoir, is transferred via a valve within a very short time interval to the surface of the granular material so as to impact on the surface of the material being compressed. The pressure is maintained on the surface of the granular material for a predetermined time interval and thereafter the pressure is reduced by means of venting.

U.S. Pat. No. 4,828,007 discloses an improved process for selectively compressing granular material in a molding box. The process of the 4,828,007 patent relies on two sequential pressure surges for final compaction of the molding sand wherein the pressure gradient of the first pressure surge is smaller than the pressure gradient of the second pressure surge.

It has been found by the inventors that, when dealing with mold patterns having significant height differences in complex pattern contour, prior art processes do not always yield homogeneous compacted molds having high hardness values.

Naturally, it would be highly desirable to provide a process which allows for uniform compression of sand molds of high hardness when employing mold patterns having complex pattern contour and significant height differences.

Accordingly, it is a principal object of the present invention to provide a process for compressing granular materials in a molding box.

It is a particular object of the present invention to provide a process as aforesaid employing a precompression step followed by a final compression step. It is a further particular object of the present invention to provide a process as set forth above wherein the precompression step is carried out by the sequential application of a first pressure surge followed uninterruptedly by a second pressure surge wherein the rate of pressure change over time of the second pressure surge is greater than that of the first pressure surge.

Further objects and advantages of the present invention will appear hereinbelow.

SUMMARY OF THE INVENTION

In accordance with the present invention the foregoing objects and advantages are readily obtained.

The present invention relates to a process for compressing granular material in a molding box. The mold apparatus employed in the process of the present invention comprises a patter plate, a casting pattern on the pattern plate and a mold frame mounted on the pattern plate so as to define therewith a mold cavity around the casting pattern. The process of the present invention comprises the specific steps of feeding a granular material to the mold cavity such that the granular material surrounds and covers the casting pattern thereby forming a surface layer of granular material within the mold cavity. It is preferred that the granular material is fed to the molding cavity by means of compressed gas. Once the granular is fed to the molding cavity the granular material precompressed by applying a first pressure surge of compressed gaseous medium to the surface layer of the granular material at a first rate of pressure change over time (dp/dt) so as to produce a first pressure over the material so as to produce a first pressure p1 over said material and thereafter applying a second pressure surge of compressed gaseous medium to the surface layer of the granular material at a second rate of pressure change over time so as to produce a second pressure p2 over the material wherein the second rate of pressure change over time is greater than the first rate of pressure change over time. It is preferred in accordance with the present invention that the second pressure surge is applied immediately after the first pressure surge in an uninterrupted manner. After the application of the second pressure surge of the precompression step, the granular material is subjected to final compression by compacting the precompacted granular material by either mechanical or pneumatic means. The process of the present inventions as aforesaid results in a mold having high hardness uniform throughout the sand mold.

BRIEF DESCRIPTION OF THE DRAWINGS

The FIGURE is a graph illustrating the process of the present invention.

DETAILED DESCRIPTION

The degree of compression in the pattern area is initially a function of the configuration of the pattern plate. Thus, the narrower the intervals between the individual pattern areas or between the pattern and the enclosing wall frame, the more problematic is the compression of the granular material in these areas. Most areas with deep pockets or narrow mold clearances cannot always be filled optimally with granular material during the filling of the mold cavity with the granular material. The subsequent setting compression surge used in known processes can therefore lead to irregular hardness values which causes defective portions in the compressed mold.

It has been found, however, in accordance with the present invention that a mold of uniform hardness can be obtained in a two stage process (graphically represented in the FIGURE) comprising a precompaction stage in a final compaction stage wherein the precompaction stage consists of a series of pressures surges wherein the pressure gradient (dp/dt) of the second pressure surge is greater than that of the first pressure surge. In accordance with the present invention the first pressure surge at a first rate of pressure change over time, that is, pressure gradient of between 0.1 to 10 bar/second, ideally the 3 bar/second and the second pressure gradient is between 0.1 to 80 bar/second, preferably 1 to 50 bar/second, ideally about 30 bar/second. In accordance with the present invention the second pressure surge is applied immediately after the first pressure surge in an interrupted, that is, without any time delay between the first pressure surge and the second pressure surge. The first pressure surge is applied so as to produce a first pressure p1 over the material and thereafter the second pressure surge is applied so as to produce a second pressure p2 over the material where p2 is greater than p1. Following the precompaction by the series of pressure surges as set forth above, the granular material is subject to final compaction by compacting the precompacting granular material by any known method known in the art such as pneumatic means or mechanical means or a combination of mechanical and pneumatic means.

Since, in accordance with the present invention, the second pressure surge of the precompression precompaction stage follows immediately after the first pressure surge the air which fluidizes the granular material from the first pressure surge has not yet left the molding space thereby rendering the molding material in a state of fluidization. Because the granular material is in a fluidized state, the flowability of the granular material is improved which allows for the granular material to penetrate all areas of the pattern during the second pressure surge of the precompaction stage. In this way the compactibility of the molding sand is improved significantly in the narrow areas between pattern parts thereby resulting in a superior sand mold after final compaction is performed.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A process for compressing granular material in a molding box having a pattern plate, a casting pattern on said pattern plate and a mold frame mounted on said pattern plate so as to define therewith a mold cavity around said casting pattern comprising the steps of:

(a) feeding said granular material to said mold cavity such that said granular material surrounds and covers said casting pattern thereby forming a surface layer of said granular material;

(b) precompacting said granular material by applying a first pressure surge of compressed gaseous medium to said surface layer of said granular material at a first rate of pressure change over time so as to produce a first pressure p1 over said material followed immediately by a second pressure surge of compressed gaseous medium to said surface layer of said granular material in an uninterrupted manner at a second rate of pressure change over time so as to produce a second pressure p2 over said material wherein said second rate of pressure change over time is greater than said first rate of pressure change over time;

(c) reducing said second pressure p2 to a third pressure p3; and (d) further compacting said precompacted granular material to final compaction.

2. A process according to claim 1 compacting to final compaction by mechanical compressing.

3. A process according to claim 1 compacting to final compaction by pneumatic compressing.

4. A process according to claim 1 wherein said second pressure surge is at a second rate of between about 0.1 to 80 bar/second.

5. A process according to claim 1 wherein said second pressure surge is at a second rate of between about 1 to 50 bar/second.

* * * * *